US011380345B2

(12) United States Patent
Feng et al.

(10) Patent No.: US 11,380,345 B2
(45) Date of Patent: Jul. 5, 2022

(54) REAL-TIME VOICE TIMBRE STYLE TRANSFORM

(71) Applicant: Agora Lab, Inc., Santa Clara, CA (US)

(72) Inventors: Jianyuan Feng, Shanghai (CN); Ruixiang Hang, Shanghai (CN); Linsheng Zhao, Shanghai (CN); Fan Li, Shanghai (CN)

(73) Assignee: Agora Lab, Inc., Santa Clara, CA (US)

( * ) Notice: Subject to any disclaimer, the term of this patent is extended or adjusted under 35 U.S.C. 154(b) by 0 days.

(21) Appl. No.: 17/071,454

(22) Filed: Oct. 15, 2020

(65) Prior Publication Data

US 2022/0122623 A1 Apr. 21, 2022

(51) Int. Cl.
*G10L 21/013* (2013.01)
*G10L 25/51* (2013.01)

(52) U.S. Cl.
CPC ..... *G10L 21/013* (2013.01); *G10L 25/51* (2013.01); *G10L 2021/0135* (2013.01)

(58) Field of Classification Search
CPC ..... G10L 21/013; G10L 2021/0135
See application file for complete search history.

(56) References Cited

U.S. PATENT DOCUMENTS

RE37,864 E * 10/2002 Akagiri ..... G11B 20/10527 341/118
2007/0192100 A1* 8/2007 Rosec ..... G10L 21/00 704/E21.001
2008/0240282 A1* 10/2008 Lin ..... H04L 25/022 375/285
2009/0281811 A1* 11/2009 Oshikiri ..... G10L 19/0208 704/500
2021/0217431 A1* 7/2021 Pearson ..... G06N 3/088

OTHER PUBLICATIONS

Turk, O. (2007). Cross-lingual voice conversion. Bogazii University, 3.*

* cited by examiner

*Primary Examiner* — Bryan S Blankenagel
(74) *Attorney, Agent, or Firm* — Young Basile Hanlon & MacFarlane, P.C.

(57) ABSTRACT

Transforming a voice of a speaker to a reference timbre includes converting a first portion of a source signal of the voice of the speaker into a time-frequency domain to obtain a time-frequency signal; obtaining frequency bin means of magnitudes over time of the time-frequency signal; converting the frequency bin magnitude means into a Bark domain to obtain a source frequency response curve (SR), where SR(i) corresponds to magnitude mean of the $i^{th}$ frequency bin; obtaining respective gains of frequency bins of the Bark domain with respect to a reference frequency response curve (Rf); obtaining equalizer parameters using the respective gains of the frequency bins of the Bark domain; and transforming the first portion to the reference timbre using the equalizer parameters.

20 Claims, 5 Drawing Sheets

REAL-TIME VOICE TIMBRE STYLE TRANSFORM

CROSS REFERENCES TO RELATED APPLICATIONS

None.

TECHNICAL FIELD

This disclosure relates generally to speech enhancement and more specifically to voice timbre style transform in, for example, real-time applications.

BACKGROUND

Many interactions occur online over different communication channels and via many media types. An example of such interactions is real-time communication (RTC) using video conferencing or streaming or a simple telephone voice calls. The video can include audio (e.g., speech, voice) and visual content. One user (i.e., a sending user) may transmit (e.g., the video) to one or more receiving users. For example, a concert may be live-streamed to many viewers. For example, a teacher may live-stream a classroom session to students. For example, a few users may hold a live chat session that may include live video.

In real-time communications, some users may wish to add filters, masks, and other visual effects to add an element of fun to the communications. To illustrate, a user can select a sunglasses filter, which the communications application digitally adds to the user's face. Similarly, users may wish to modify their voice. More specifically, users may wish to modify the timbre, or tone color, of their voice in an RTC session.

SUMMARY

A first aspect is a method for transforming a voice of a speaker to a reference timbre. The method includes converting a first portion of a source signal of the voice of the speaker into a time-frequency domain to obtain a time-frequency signal; obtaining frequency bin means of magnitudes over time of the time-frequency signal; converting the frequency bin magnitude means into a Bark domain to obtain a source frequency response curve (SR), where SR(i) corresponds to magnitude mean of the $i^{th}$ frequency bin; obtaining respective gains of frequency bins of the Bark domain with respect to a reference frequency response curve (Rf); obtaining equalizer parameters using the respective gains of the frequency bins of the Bark domain; and transforming the first portion to the reference timbre using the equalizer parameters.

A second aspect is an apparatus for transforming a voice of a speaker to a reference timbre. The apparatus includes a processor that is configured to convert a first portion of a source signal of the voice of the speaker into a time-frequency domain to obtain a time-frequency signal; obtain frequency bin means of magnitudes over time of the time-frequency signal; convert the frequency bin magnitude means into a Bark domain to obtain a source frequency response curve (SR), where SR(i) corresponds to magnitude mean of the $i^{th}$ frequency bin; obtain respective gains of frequency bins of the Bark domain with respect to a reference frequency response curve (Rf); obtain equalizer parameters using the respective gains of the frequency bins of the Bark domain; and transform the first portion to the reference timbre using the equalizer parameters.

A third aspect is a non-transitory computer-readable storage medium that includes executable instructions that, when executed by a processor, facilitate performance of operations including converting a first portion of a source signal of the voice of the speaker into a time-frequency domain to obtain a time-frequency signal; obtaining frequency bin means of magnitudes over time of the time-frequency signal; converting the frequency bin magnitude means into a Bark domain to obtain a source frequency response curve (SR), where SR(i) corresponds to magnitude mean of the $i^{th}$ frequency bin; obtaining respective gains of frequency bins of the Bark domain with respect to a reference frequency response curve (Rf); obtaining equalizer parameters using the respective gains of the frequency bins of the Bark domain; and transforming the first portion to the reference timbre using the equalizer parameters.

It will be appreciated that aspects can be implemented in any convenient form. For example, aspects may be implemented by appropriate computer programs which may be carried on appropriate carrier media which may be tangible carrier media (e.g. disks) or intangible carrier media (e.g. communications signals). Aspects may also be implemented using suitable apparatus which may take the form of programmable computers running computer programs arranged to implement the methods and/or techniques disclosed herein. Aspects can be combined such that features described in the context of one aspect may be implemented in another aspect.

BRIEF DESCRIPTION OF THE DRAWINGS

The description herein makes reference to the accompanying drawings wherein like reference numerals refer to like parts throughout the several views.

DETAILED DESCRIPTION

Figure 1:
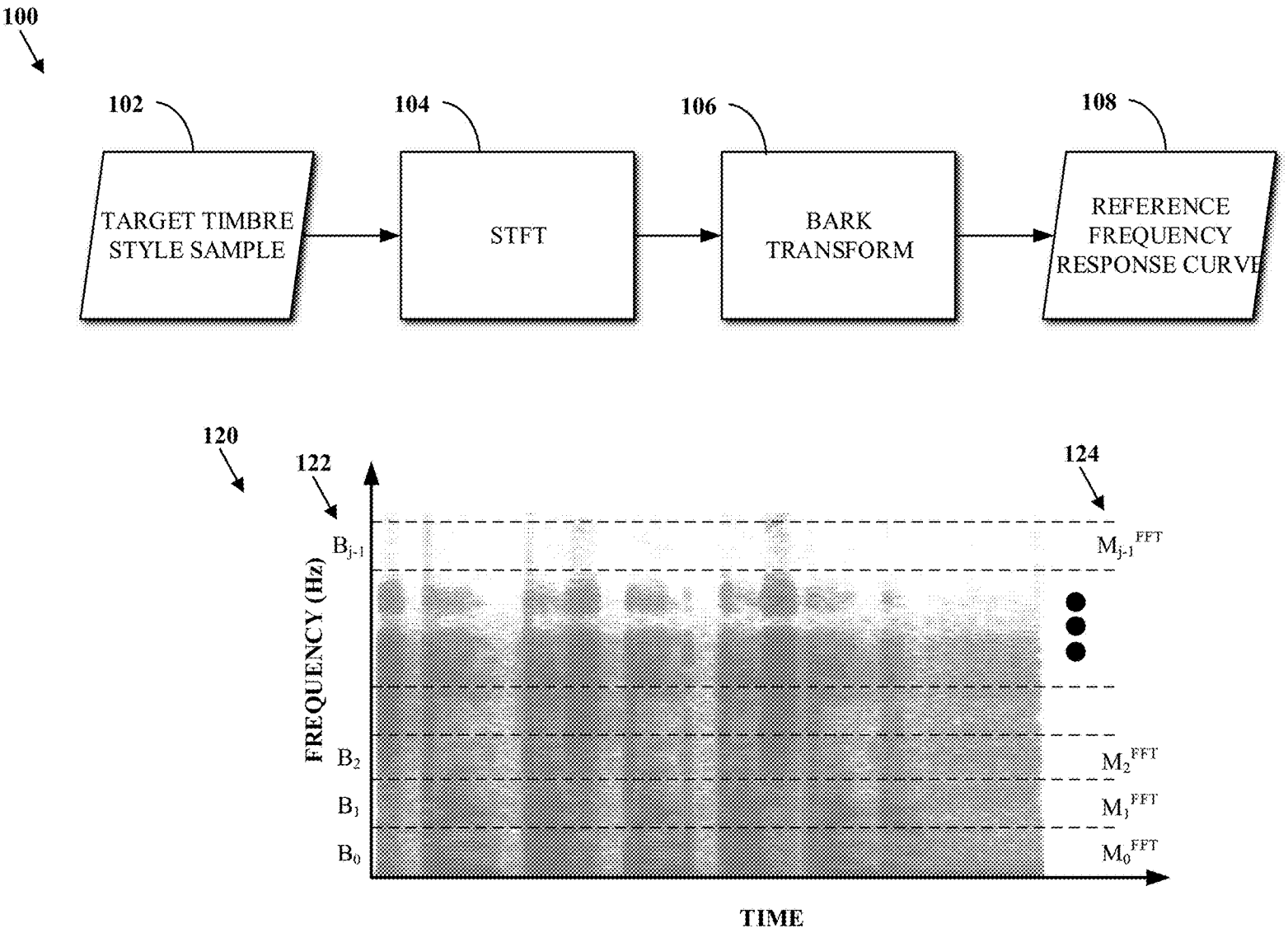
FIG. 1 is a diagram of an example of a technique of a prepare phase of timbre style transform according to implementations of this disclosure.

Timbre, also known as tone color, is the distinguishing characteristic that differentiates one sound from another. For example, while two instruments (e.g., a piano and a violin) may be playing the same note at the same frequency and at the same frequency amplitude, the note will be heard differently. Words such as sharp, round, reedy, brassy, bright, magnetic, vigorous, light, flat, smooth, smoky, breathy, rough, or fresh can be used to describe timbre.

Different people or music styles have different timbres. Put more simply, different people and different music styles sound differently. A person may wish to sound different. That is, the person may wish to change his/her timbre, such as during an RTC session. The timbre of a voice (or sound) can be understood to be comprised of different energy levels in different frequency bands.

Changing the timbre, such as, of a recorded sound is possible. Professional audio producers, such as broadcasters or music makers, often use sophisticated hardware or software equalizers to change the timbre of different voices or instruments in a recording. To illustrate, a composer may record, in multiple tracks, all portions of an orchestral composition using one instrument. Using an equalizer, the timbre of each track can be modified to be that of the target instrument of that track.

Using an equalizer amounts to finding equalizer parameters for tuning different aspects of an audio spectrum. Such parameters include gains (e.g., amplitudes) of certain frequency bands, center frequency (e.g., adjusting the center frequency ranges of selected frequency bands), bandwidth, filter slopes (e.g., steepness of a filter when selecting either a low cut or a high cut filter), tilter types (e.g., filter shapes for the selected frequency bands), and the like. For example, with respect to gain, a center frequency can be cut or boosted by a certain number of decibels (dB). Bandwidth refers to the frequency range located on either side of a center frequency. When a particular frequency is altered, other frequencies that are above and below the particular frequency are typically also affected. The range of affected frequencies is referred as the bandwidth. With respect to filter types, many filter types may be available and can include low cut, high cut, low shelf, high shelf, notch, bell, or other filter types.

As can be appreciated from the foregoing high level and simplified description, using an equalizer can be complicated, beyond the reach of an average user, and impractical in real-time applications.

Implementations according to this disclosure can be used to transform the timbre of a voice, such as the voice of a user in a real-time communication application. As is known, in RTC, there can be a sending user and a receiving user. An audio stream, such as the voice of sending user, can be sent from a sending device of the sending user to a receiving device of the receiving user. The sending user may wish to change the timbre of his/her voice to a certain (e.g., reference, desired, etc.) style or the receiving user may wish to change the timbre of the sending user's voice to that certain style.

The techniques described herein can be used at a sending user's device (i.e., a sending device), a receiving user's device (e.g., a receiving device), or both. The sending user, as used herein, is a person who may be speaking and whose speech is to be transmitted to and heard by the receiving user. The techniques described can also be employed by a central server (e.g., a cloud-based server) that may receive an audio signal from a sending user and relay the audio signal to the receiving user.

For example, via a user interface of an RTC application that may be used by the sending user using the sending device, the sending user can select a timbre style that the sending user's voice is to be transformed to prior to sending to the receiving user. Similarly, via a user interface of an RTC application that may be used by the receiving user using the receiving device, the receiving user can select a timbre style that the sending user's voice is to be transformed to prior to being heard by (i.e., output to) the receiving user. The user may wish to transform the timbre to a certain style to fit a certain situation, such as news reporting or music style (e.g., jazz, hip-hop, etc.).

Transforming the timbre of a speaker (i.e., the voice of the speaker) to a reference (e.g., desired, target, selected, etc.) timbre includes a setup (e.g., prepare, train, etc.) phase and a real-time phase. In the setup phase, a reference frequency response curve for a target (e.g., reference, etc.) voice timbre style is generated. In the real-time phase, a source voice timbre can also be described by a source domain frequency response curve. The difference between the source frequency response curve of the source voice timbre and the reference frequency response curve of the reference voice timbre can be used by a mapping technique, as further described below, to obtain parameters of an equalizer that is then applied to the source voice.

For example, in the setup phase, a reference sample of the target timbre can be received and a Bark frequency response curve can be obtained from the reference sample; in the real-time phase, the Bark frequency response curve can be used, in real-time, to transform a source voice sample (e.g., frames of the source voice sample) of the speaker to the target timbre.

As is known, the Bark transform is the result of psychoacoustic experiments and is defined so that the critical bands of human hearing each has a width of one Bark. The Bark scale represents the spectral information processing in the human ear. Stated differently, the Bark domain reflects the psychoacoustic frequency response thereby providing better information on how humans recognize the power difference in the different frequency bands.

Other perceptual transforms, or scales, can also be used. For example, the MEL scale may be used. Whereas the MEL scale reflects a human's perception of pitch, the Bark scale reflects a human's subjective loudness perception and energy integration. However, energy distribution in different frequency bands may be more relevant to timbre transform (e.g., change) than pitch.

In some situations, a constant-parameter equalizer may not be suitable for long-term use. That is, a constant-parameter equalizer may not be suitable for use for the duration of an RTC session. To illustrate, the timbre of the speaker may change five minutes into an RTC session, such as due to emotion or to a changing singing style; or another person, with a different timbre altogether, may start talking instead of the original speaker. Such change in timbre may require a dynamic change to the parameters of the equalizer so that the changed timbre style can still be transformed to the target timbre style. As such, if the speaker's timbre changes during an RTC session, the changing timbre can still be changed to the target timbre. Accordingly, parameters of the equalizer can be dynamically updated.

The disclosure herein mainly describes the transformation of the timbre of a single voice or sound. In the case of multiple voices, techniques such as voice source separation can be used to separate the voices and apply timbre transform as described herein to each voice separately. Additionally, the source voice may be noisy or reverberant. In some examples, denoising and/or dereverberation techniques can be applied to the source voice prior to transforming the timbre as described herein.

FIG. 1 is a diagram of an example of a technique 100 of a prepare (e.g., setup) phase of timbre style transform according to implementations of this disclosure. The technique 100 receives a reference sample of a target timbre style and generates a reference (e.g., target) frequency response curve of the target timbre. The technique 100 can be used off-line to generate the reference frequency response curve. To illustrate, and without loss of generality, a speaker may wish his/her sound to be like that of the singer Justin Bieber; thus, a reference voice sample of the singer can be used as the target timbre style sample. As another example, the user may wish to sound vigorous during RTC sessions; thus, a recording of a vigorous sound can be used as the reference sample.

The technique 100 can be repeated for each desired (e.g., reference) timbre style to generate a corresponding reference frequency response curve (R f). In an example, as gender differences may have a large influence on the timbre, for the same desired timbre, a male reference sample and a female reference sample can be used to obtain two frequency response curves of the desired timbre. The lengths of the two samples (i.e., the sample of the male voice and the sample of the female voice) can be the same or can be different.

At 102, the technique 100 receives a reference voice sample (i.e., a reference signal) of the desired (i.e., target) timbre style. The reference voice sample can include at least one period of vocal wave signals. The reference voice sample can be in any format. In an example, the voice sample can be a waveform audio file (wave or way file), an MP3 file, a window media audio (wma), an audio interchange file format (aiff), or the like. The reference voice sample can be a few (e.g., 0.5, 1, 2, 5, more, or fewer) minutes in length. In an example, the technique 100 can receive a longer voice sample from which a shorter reference voice sample is extracted.

At 104, the technique 100 converts the reference voice sample to the transform domain. The technique 100 can use the short-time Fourier transform (STFT) to convert the reference signal to the time-frequency domain. The STFT can be used to obtain the magnitudes of each frequency in the reference voice sample over time. As is known, the STFT calculates the Fast Fourier Transform (FFT) over a defined window length and a hop length, representing a number of samples of the voice sample, and producing both magnitude and phase information over time.

At 106, the technique 100 transforms the means of magnitudes in the time dimension of the time-frequency domain signal to the Bark domain to obtain the reference frequency response curve (Rf) 108, which is psychoacoustic frequency response curve.

As is known, the time-domain results of the STFT can be visualized on a spectrogram, such as the merely illustrative spectrogram 120 of FIG. 1. The spectrogram 120 shows the frequency content of signals when that frequency content varies with time. Time is shown on the x-axis of the spectrogram 120; frequency is shown on a y-axis of the spectrogram 120; and the frequency magnitudes are typically indicated by color intensities (i.e., gray scale levels in the spectrogram 120).

The spectrogram 120 illustrates that there are j frequency bins 122 ($B_j$, j=0, . . . , j−1 where j is the number of frequency bins). Means of magnitudes 124 over time, $M_j^{FFT}$ for j=0, . . . , k−1, can be calculated for the frequency bins, $B_j$, respectively. The mean of magnitudes $M_j^{FFT}$ can be, as the name implies, the mean of at least a subset (e.g., all) of the magnitudes of the frequency bin $B_j$ over all the time windows (i.e., the time axis, the horizontal dimension). As such, each $M_j^{FFT}$ represents an average frequency magnitude response of the frequency bin $B_k$. To illustrate, with respect to spoken words for example, the means of magnitudes can represent the average performance in different (types of) words that are pronounced in the reference voice sample. $M_j^{FFT}$ can be calculated as $$M_j^{FFT} = \sum_{t=1}^{n} m_{t,j}$$

where $m_{t,j}$ is me magnitude of spectrum where t and j are the time and frequency indexes, respectively, and where n is the last time index of the voice sample.

The means of magnitudes are converted (i.e., transformed, mapped, etc.) from the STFT domain to the $i^{th}$ Bark domain magnitude ($M_u^{Bark}$) though mapping magnitudes of the FFT frequency bins ($M_j^{FFT}$) to bark frequency bins using formula (1):

$$M_i^{Bark}=\Sigma_{j\in B_i}\beta_{ij}*M_j^{FFT} \quad (1)$$

Formula (1) represents a conversion from the Fourier to the Bark domain. The Bark domain magnitudes, $M_i^{Bark}$, for i=1, . . . , 24, constitute the reference frequency response curve, Rf.

The Bark scale can range from 1 to 24, corresponding to the first 24 critical bands of hearing. The Bark band edges are given, in Hertz (Hz), as [0, 100, 200, 300, 400, 510, 630, 770, 920, 1080, 1270, 1480, 1720, 2000, 2320, 2700, 3150, 3700, 4400, 5300, 6400, 7700, 9500, 12000, 15500]; and the band centers in Hertz are [50, 150, 250, 350, 450, 570, 700, 840, 1000, 1170, 1370, 1600, 1850, 2150, 2500, 2900, 3400, 4000, 4800, 5800, 7000, 8500, 10500, 13500]. Thus, i ranges from 1 to 24. In another example, the Bark scale used can contain 109 bins. As such, i can range from 1 to 109 and the whole frequency can range from 0 to 24000 Hz.

As mentioned above, $B_i$s in formula (1) are the FFT frequency bins in $i^{th}$ Bark frequency band; and the coefficients $\beta_{ij}$ are the Bark transform parameters. It is noted that the Bark domain transform can smooth the frequency response curve therewith eliminating any frequency outliers. The Bark transform is an auditory filter bank that can be thought of as calculating a moving average that smoothes the frequency response curve. The coefficients $\beta_{ij}$ are triangle shaped parameters, as described with respect to FIG. 2.

Figure 2:
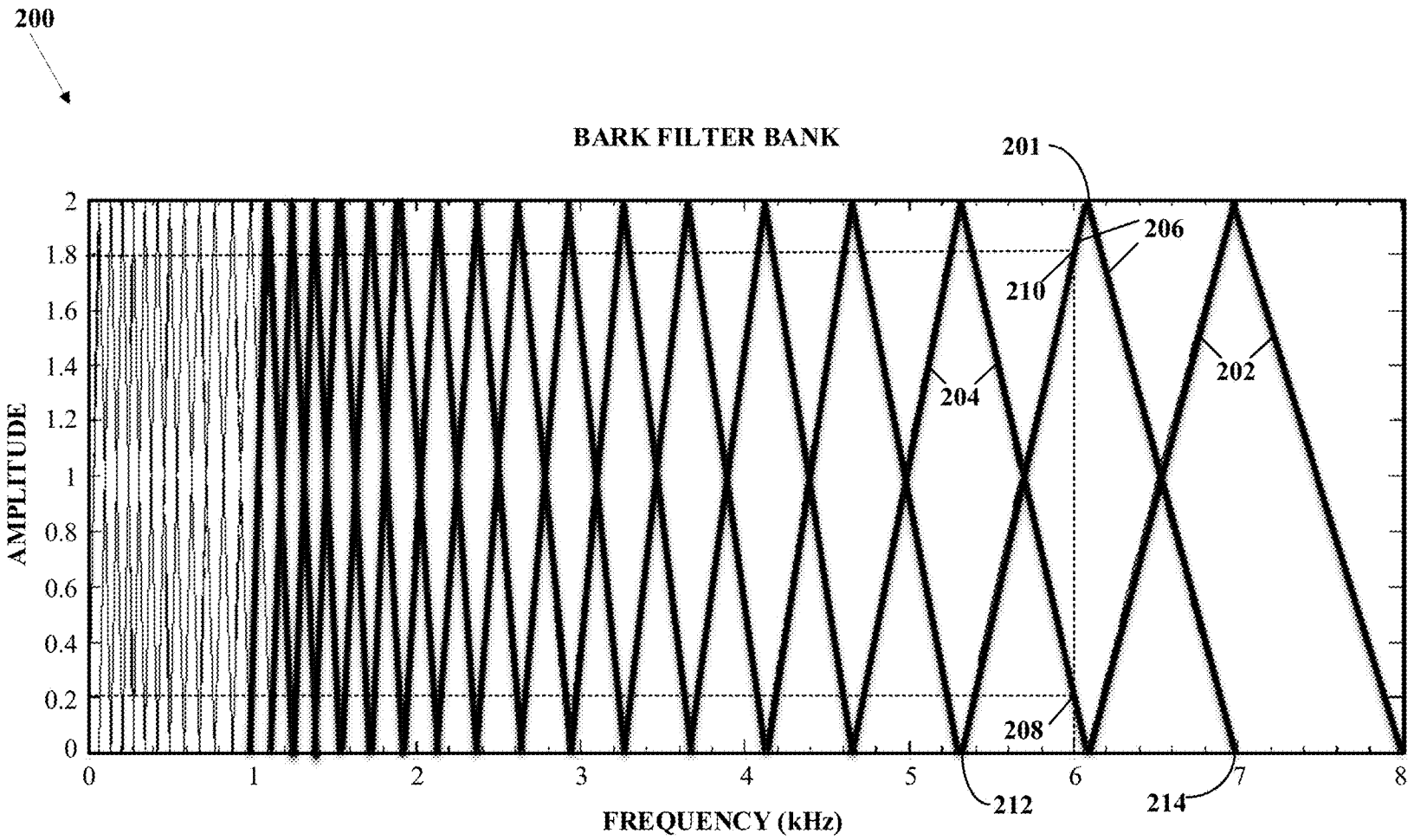
FIG. 2 illustrates the Bark filter bank according to implementations of this disclosure.

FIG. 2 illustrates the Bark filter bank 200 according to implementations of this disclosure. So as not to not overly clutter FIG. 2, it is noted that the Bark filter bank 200 illustrates only 29 bins and a frequency range of 0 to 8000 Hz. The number of triangles in FIG. 2 should equal to number of bins. The filter bank 200 is used to illustrate how the coefficients $\beta_{ij}$ of formula (1) are obtained. The coefficient $\beta_{ij}$ are the Bark transform coefficients of the STFT. In the coefficient $\beta l_{ij}$, the index i corresponds to a Bark frequency bin and the index j corresponds to an FFT frequency bin. The index j corresponds to the x-axis in FIG. 2; and the index i corresponds to a frequency. Each coefficient $\beta_{ij}$ is determined in two dimensions: it is determined first by which triangle is to be used and second by which frequency bin the $M_j^{FFT}$ corresponds to.

Each of the Bark filters is a triangular band-pass filter, such as the filter 202, with certain overlaps. The peeks of the Bark filter bank 200, such as a peek 201, correspond to the center frequencies of the different Bark filters. It is to be noted that, in FIG. 2, some triangles have are drawn to have thicker lines than other triangles. This is merely so as not to clutter the figure. No meaning should be ascribed to the fact that some triangles are drawn with thinner sides.

Using j=6 as an example, as can be seen in FIG. 2, j=6 is within two triangles (namely, triangles 204 and 206). The triangle 204 corresponds, approximately, to the frequency band 4200 Hz to 6300 Hz; and triangle 206 corresponds, approximately, to the frequency band 5300 Hz to 7000 Hz. Projecting j=6 upward, the right side of the triangle 204 is intersected at a point 208, which corresponds to $\beta=0.2$; and the left side of the triangle 206 is intersected at a point 210, which corresponds to $\beta=1.8$.

To illustrate further, and without loss of generality, with respect to the triangle 206, and referring to the formula (1), an index i=28 ($M_i^{Bark}$) refers to the $28^{th}$ triangle or the $28^{th}$ Bark frequency band; the center frequency is the horizontal-axis value (i.e., the x value) of the top of triangle 206 (i.e. the peek 201), which is 6150 Hz; and $B_i$ of formula (1) represent the frequency bins in the range from 5300 (i.e., a point 212) to 7000 Hz (i.e., a point 214), which are determined by the bottom of triangle 206. Taking one of the $M_i^{Bark}$ for $j \epsilon B_i$ as an example, whose $j^{th}$ frequency bins is at 6000 Hz, then according to the y axis projection of the triangle 206 at frequency 6000 Hz, the $\beta_{i=28,j}$ is 1.8. Thus, for the $M_{i=28}^{Bark}$, and assuming, for example, an FFT size of 1024 and a sampling rate of 16 kHz and that there are 109 pairs of $M_j^{FFT}$ and that $\beta_{ij}$ is in range 5300 to 7000 Hz, then $M_{i=28}^{Bark}$ can be calculated as $M_{i=28}^{Bark}=\sum_{j \epsilon B_i} \beta_{i=6100,j} * M_h^{FFT}$.

Figure 3:
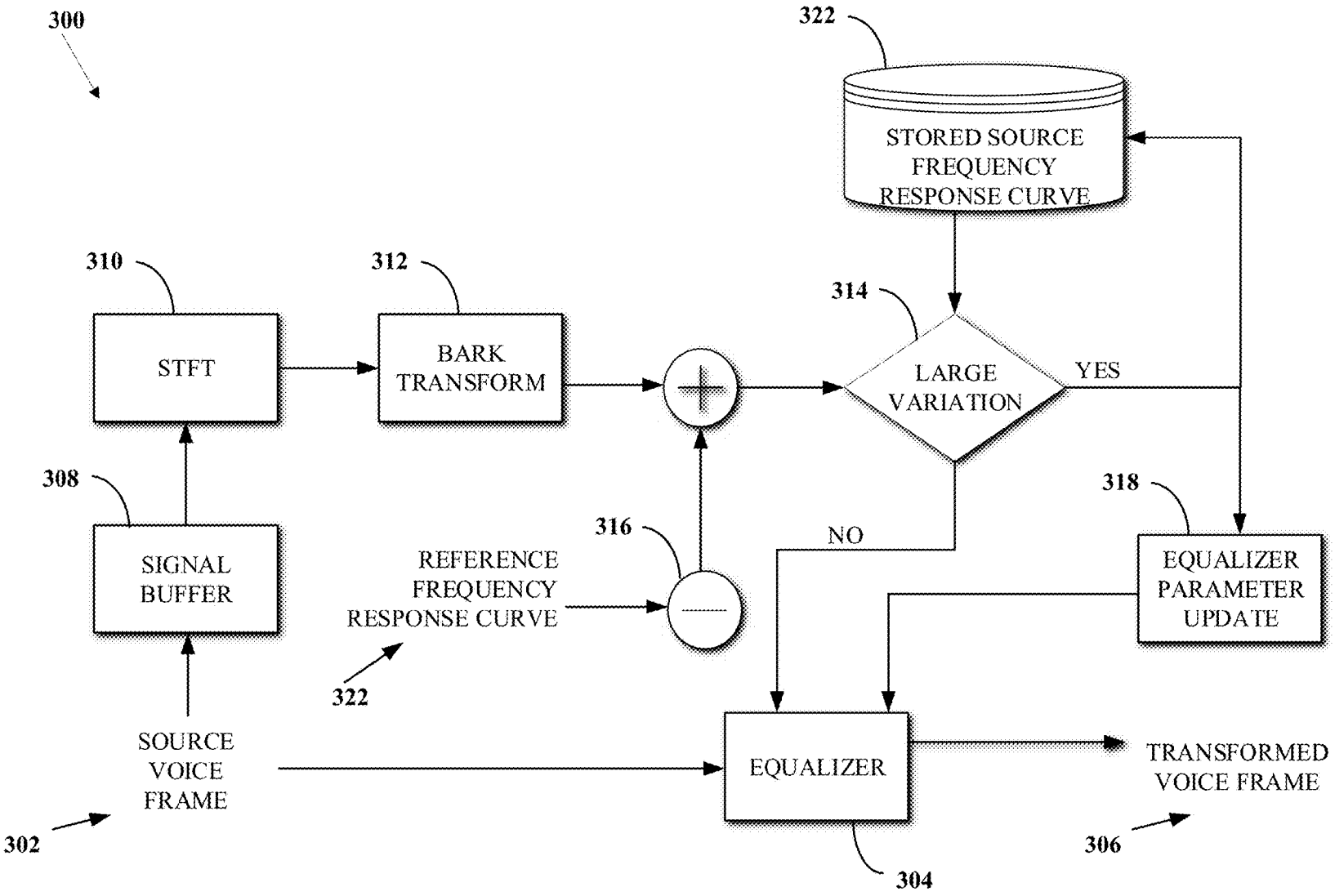
FIG. 3 is a diagram of an example of a technique of a real-time phase of timbre style transform according to implementations of this disclosure.

FIG. 3 is a diagram of an example of a technique 300 of a real-time phase of timbre style transform according to implementations of this disclosure. The technique 300 can be used in real-time applications, such as audio and/or video conferencing, telephone conversations, and the like, to transform the timbre of a source voice of at least one of the participants. The technique 300 receives the source voice in frames, such as a source voice frame 302. In another example, the technique 300 itself can partition a received audio signal into the frames. A frame can correspond to an m number of milliseconds of audio. In an example, m can be 20 milliseconds. However, other values of m are possible. The technique 300 outputs (e.g., generates, obtains, results in, calculates, etc.) a transformed voice frame 306. The source voice frame 302 is in a source timbre style and the transformed voice frame 306 that is in a reference timbre style.

Figure 4:
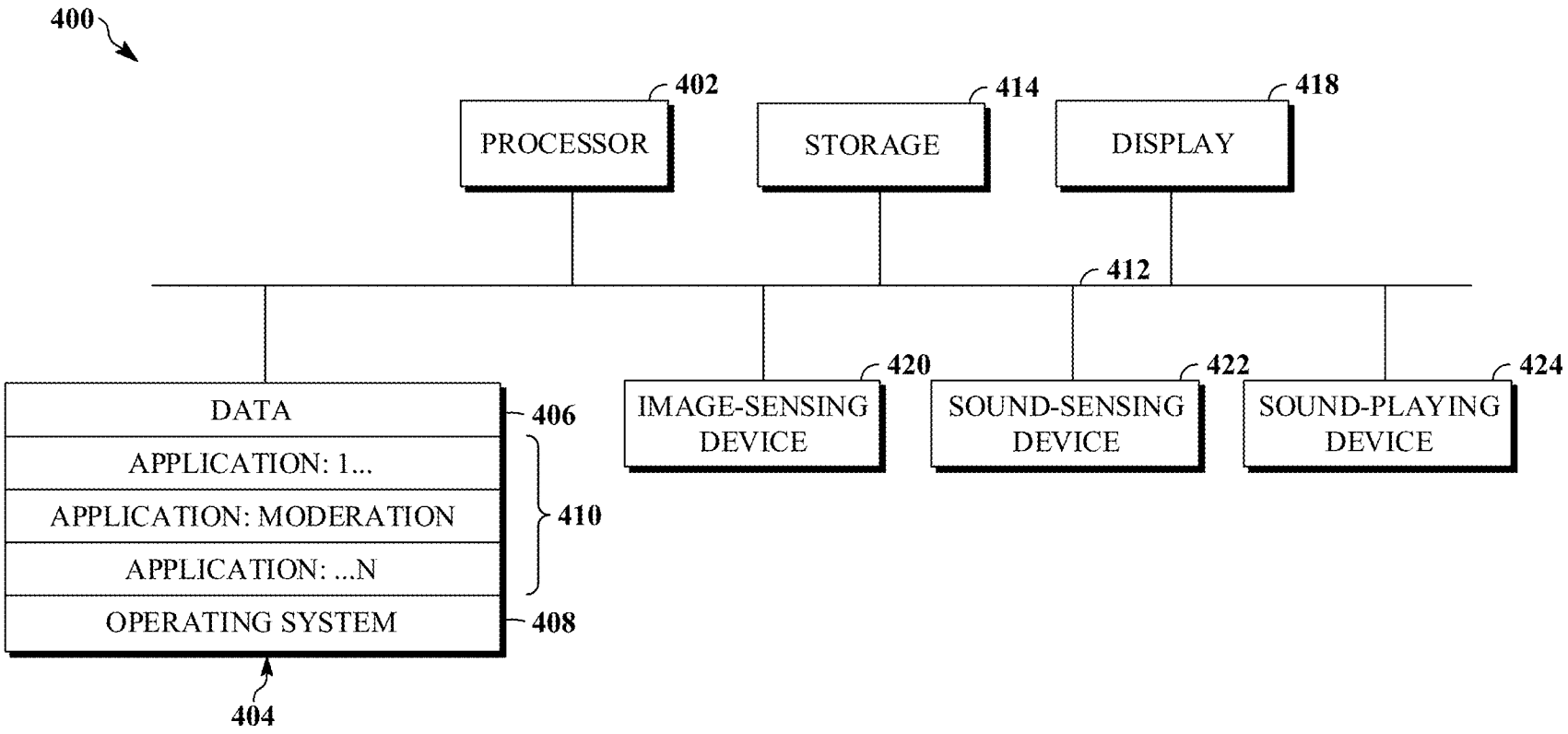
FIG. 4 is a block diagram of an example of a computing device in accordance with implementations of this disclosure.

The technique 300 can be implemented by a computing device, such as the computing device 400 described with respect to FIG. 4.

The technique 300 can be implemented by a sending device. Thus, the timbre style of the speaker can be transformed to a reference timbre on the device of the sending user, before transmission to a receiving user, so that the receiving user can receive the voice of the sending user in the reference timbre. The technique 300 can be implemented by a receiving device. Thus, the voice received at the receiving device of a receiving user can be transformed to a reference timbre that may be selected by the receiving user. The technique 300 can be performed on the received speech to produce transformed speech with the reference timbre. The transformed speech is then output to the receiving user. The technique 300 can be implemented by a central server, which receives a voice sample in a source timbre from a sending device, performs the technique 300 to obtain a voice in a reference (e.g., desired, etc.) timbre, and transmit (e.g., forward, relay, etc.) the transformed speech to one or more receiving devices.

The source voice frame 302 can be processed via an equalizer 304 to produce the transformed voice frame 306. The equalizer 304 transforms the timbre using equalizer parameters, which are initially calculated and later updated, upon detection of large variations, as described below.

The technique 300 obtains (e.g., calculates, looks up, determines, etc.) the gap between the reference frequency response curve (Rf) of the reference sample and the source frequency response curve (SR) of the source sample. The technique 300 can obtain the gap (e.g., difference) in each of the frequency bins. That is, the technique 300 can obtain the gain(s) in amplification between the reference frequency response curve (Rf) of the reference sample and the source frequency response curve (SR) of the source sample. In an example, the gain can be obtained in the logarithmic scale. The gap can be obtained in decibels (dB). As is known, a decibel (dB) is a ratio between two quantities reported on a logarithmic scale and allows for a realistic modelling of human auditory perception.

For each $k^{th}$ frequency bin of the Bark domain, the technique 300 can calculate the dB difference, $G^b$ (k), between the source and the reference psychoacoustic frequency response curves using formula (2).

$$G^b(k)=20*\log(Rf(k)/SR(k)) \tag{2}$$

To reiterate, formula (2) can be used to measure the gain in amplification, in each of the Bark frequency bins, between reference frequency response curve (Rf) and the source frequency response curve (SR). The set of gains $G^b$ (k) for all of the Bark domain frequency bins can constitute (e.g., can be considered to be, can be the basis for obtaining, etc.) the parameters of the equalizer 304. Again, the equalizer 304 uses the equalizer parameters to transform the timbre of the source voice to the reference timbre style.

The equalizer 304 is a set of filters. To illustrate, the equalizer 304 can have a filter for a lower frequency $f_n$ (e.g., 0 Hz) to upper frequency $f_{n+1}$ (e.g., 800 Hz) band, which has a center frequency of $(f_n+f_{n+1})/2$ (e.g., 400 Hz). The equalizer 304 can use the equalizer parameters (i.e., the gains $G^b$ (k)) that determine how much to add to or subtract from the center frequency to adjust the center frequency.

Interpolations parameters, which calculate the adjusted center frequency as an interpolation between the lower and upper frequencies of the frequency band, can then be determined. The interpolation parameters can also include (e.g., determine, define, etc.) a shape of the interpolation. In an example, the interpolation can be a cubic or cubic spline interpolation. Cubic spline interpolation can result in smoother interpolation than, for example, linear interpolation. The cubic spline interpolation method used to obtain an interpolation value of the $i^{th}$ gain, $G_i^e$, can be described by the following equation (3). In equation (3), the interpolation parameters $a_1$ to $d_i$ are determined by the $G^b$ (i) near to the $i^{th}$ center frequency of equalizer.

$$G_i^e=a_i+b_ix+c_ix^2+d_ix^3 \tag{3}$$

The equalizer 304 can include (e.g., use) an initial set of equalizer parameters. In an example, the initial set of equalizer parameters may be obtained from previous executions of the technique 300. For example, a store 322 can include stored reference response curve(s), stored source frequency response curve(s), and/or corresponding equalizer parameters. As such, the store 322 can include a reference frequency response curve 322 of the reference the reference timbre style. The store 322 can be a permanent storage (e.g., a database, a file, etc.) or non-permanent memory. In another example, the equalizer 304 may not include equalizer parameters. As such, Initial equalizer parameters can be obtained as described below with respect to 314-318.

As different gains may be added or subtracted for the different Bark frequency bands by the equalizer 304, the total energy of the source signal may be changed. In an example, the technique 300 can normalize the gains to keep the volumes of voice before and after equalizing by the equalizer 304 at the same (or roughly the same) levels. In an example, normalizing the gains can mean dividing each of the gains by the sum of all the gains. However, other normalizing techniques may be used.

The technique 300 can perform the operations 308-318 to obtain initial equalizer parameters and when large variations (described below) are detected.

The source voice frame 302 may be received into a signal buffer 308, which may store received voice frames until a period of source voice samples is available for further processing. In an example, the period of the source audio can be 30 seconds, 1 minute, 2 minutes, longer, or shorter period.

At 310, the technique 300 converts the voice sample to the transform domain, such as described with respect to 104 of FIG. 1. As such, the voice sample (i.e., the period of the source audio) can be transformed to the STFT domain. At 312, the technique 300 converts means of magnitudes in the time dimension of the time-frequency domain signal to the Bark domain to obtain the source frequency response curve (SR). The source frequency response curve (SR) can be obtained as described with respect to the reference frequency response curve (R f) and 106 of FIG. 1. Thus, the source frequency response curve (SR) can be a collection of Bark domain magnitudes, $M_i^{source\ Bark}$, of the source sample.

At 314, the technique 314 determines whether a large difference in source voice timbre occurs. The difference can be obtained at 316. To illustrate, and without loss of generality, during an RTC session, the source voice may be that of a first speaker (e.g., a 45-year old male). However, at some point during the RTC session, a second speaker (e.g., a 7-year old female) starts talking. As such, the source voice has changed significantly. Therefore, in an example, the technique 300 can replace the source frequency response curve (initially obtained for the first speaker) with that of the second speaker. In an example, the technique 300 can replace the source frequency response curve only when there is a large variation between a stored source frequency response curve and a current source frequency response curve. As also mentioned above, a large variation can be determined at 314 when the equalizer parameters have not yet been obtained (e.g., initialized).

At 314, if there is no large variation, then the technique 300 proceeds to 304 where the previous equalizer parameters are used. However, if there is a large variation, at 314, then the technique 300 stores the current source frequency response curve in the store 322 so that the current source frequency response curve can be compared to subsequent source frequency response curve to detect any subsequent large variations; the technique 300 also proceeds to 318 to update the equalizer parameters. That is, the technique 300 obtains the interpolations parameters, as described with respect to formula (3).

A relation threshold can be designed for large variation detection at 314. A relation coefficient can be calculated between the frequency response curve of the current period and stored, such as in the store 322. If the relation coefficient is larger than a threshold, the stored frequency response curve will be replaced by the current one, and the parameters of an equalizer will be updated. Otherwise, the equalizer and stored frequency response curve will not be updated.

As the updating of the equalizer parameters can be completed (e.g., performed, finished, etc.) within one frame of the source voice signal (e.g., 10 ms), timbre style transform according to implementations of this disclosure is not interrupted due to the updating of the equalizer parameters. That is, delays or discontinuous are experienced when the equalizer parameters are updated.

FIG. 4 is a block diagram of an example of a computing device 400 in accordance with implementations of this disclosure. The computing device 400 can be in the form of a computing system including multiple computing devices, or in the form of one computing device, for example, a mobile phone, a tablet computer, a laptop computer, a notebook computer, a desktop computer, and the like.

A processor 402 in the computing device 400 can be a conventional central processing unit. Alternatively, the processor 402 can be another type of device, or multiple devices, capable of manipulating or processing information now existing or hereafter developed. For example, although the disclosed implementations can be practiced with one processor as shown (e.g., the processor 402), advantages in speed and efficiency can be achieved by using more than one processor.

A memory 404 in computing device 400 can be a read only memory (ROM) device or a random access memory (RAM) device in an implementation. However, other suitable types of storage devices can be used as the memory 404. The memory 404 can include code and data 406 that are accessed by the processor 402 using a bus 412. The memory 404 can further include an operating system 408 and application programs 410, the application programs 410 including at least one program that permits the processor 402 to perform at least some of the techniques described herein. For example, the application programs 410 can include applications 1 through N, which further include applications and techniques useful in real-time voice timbre style transform. For example the application programs 410 can include the technique 100 or aspects thereof, to implement a training phase. For example, the application programs 410 can include the technique 300 or aspects thereof to implement real-time voice timbre style transform. The computing device 400 can also include a secondary storage 414, which can, for example, be a memory card used with a mobile computing device.

The computing device 400 can also include one or more output devices, such as a display 418. The display 418 may be, in one example, a touch sensitive display that combines a display with a touch sensitive element that is operable to sense touch inputs. The display 418 can be coupled to the processor 402 via the bus 412. Other output devices that permit a user to program or otherwise use the computing device 400 can be provided in addition to or as an alternative to the display 418. When the output device is or includes a display, the display can be implemented in various ways, including by a liquid crystal display (LCD), a cathode-ray tube (CRT) display, or a light emitting diode (LED) display, such as an organic LED (OLED) display.

The computing device 400 can also include or be in communication with an image-sensing device 420, for example, a camera, or any other image-sensing device 420 now existing or hereafter developed that can sense an image such as the image of a user operating the computing device 400. The image-sensing device 420 can be positioned such that it is directed toward the user operating the computing device 400. In an example, the position and optical axis of the image-sensing device 420 can be configured such that the field of vision includes an area that is directly adjacent to the display 418 and from which the display 418 is visible.

The computing device 400 can also include or be in communication with a sound-sensing device 422, for example, a microphone, or any other sound-sensing device now existing or hereafter developed that can sense sounds near the computing device 400. The sound-sensing device 422 can be positioned such that it is directed toward the user operating the computing device 400 and can be configured to receive sounds, for example, speech or other utterances, made by the user while the user operates the computing device 400. The computing device 400 can also include or be in communication with a sound-playing device 424, for example, a speaker, a headset, or any other sound-playing device now existing or hereafter developed that can play sounds as directed by the computing device 400.

Although FIG. 4 depicts the processor 402 and the memory 404 of the computing device 400 as being integrated into one unit, other configurations can be utilized. The operations of the processor 402 can be distributed across multiple machines (wherein individual machines can have one or more processors) that can be coupled directly or across a local area or other network. The memory 404 can be distributed across multiple machines such as a network-based memory or memory in multiple machines performing the operations of the computing device 400. Although depicted here as one bus, the bus 412 of the computing device 400 can be composed of multiple buses. Further, the secondary storage 414 can be directly coupled to the other components of the computing device 400 or can be accessed via a network and can comprise an integrated unit such as a memory card or multiple units such as multiple memory cards. The computing device 400 can thus be implemented in a wide variety of configurations.

Figure 5:
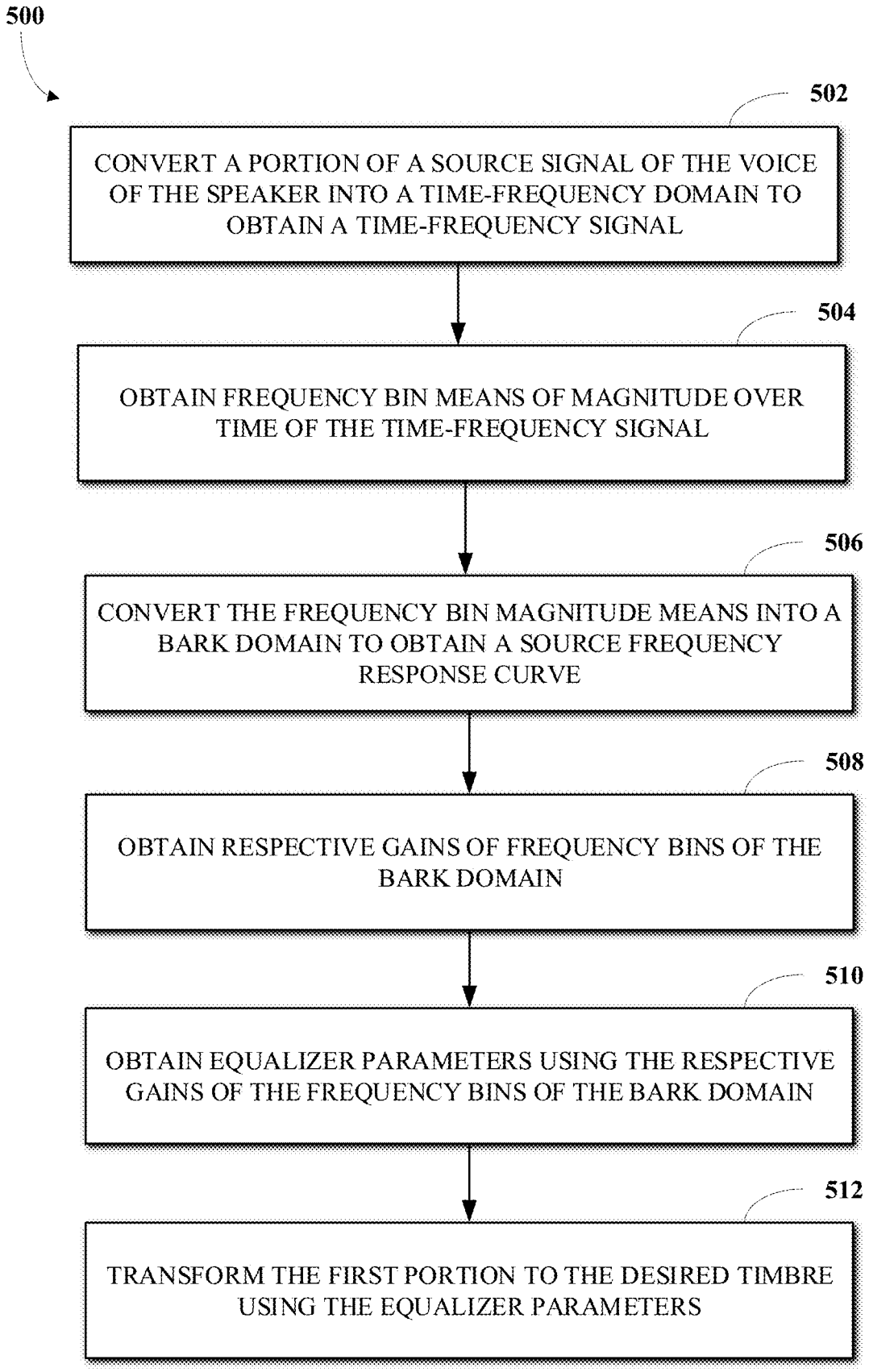
FIG. 5 is an example of a flowchart of a technique for transforming a voice of a speaker to a target timbre according to an implementation of this disclosure.

FIG. 5 is an example of a flowchart of a technique 500 for transforming a voice of a speaker to a reference timbre according to an implementation of this disclosure. In an example, the technique 500 can receive an audio sample, such as an voice stream. The audio stream can be part of a video stream. In an example, the technique 500 can receive frames of the audio stream for processing. In an example, the technique 500 can partition the audio sample into frames and process each frame separately as further described below and consistent with the description of the technique 300 of FIG. 3.

The technique 500 can be implemented by a computing device (e.g., an apparatus), such as the computing device 400 of FIG. 4. The technique 500 can be implemented, for example, as a software program that may be executed by computing devices, such as the computing device 400 of FIG. 4. The software program can include machine-readable instructions that may be stored in a memory such as the memory 404 or the secondary storage 414, and that, when executed by a processor, such as CPU 402, may cause the computing device to perform the technique 500. The technique 500 can be implemented using specialized hardware or firmware. Multiple processors, memories, or both, may be used. In an example, the reference timbre can be received from the speaker.

At 502, the technique 500 converts a portion of a source signal of the voice of the speaker into a time-frequency domain to obtain a time-frequency signal, as described above. At 504, the technique 500 obtains frequency bin means of magnitudes over time of the time-frequency signal, as described above with respect to $M_k^{FFT}$. At 506, the technique 300 converts the frequency bin magnitude means into a bark domain to obtain a source frequency response curve (SR), as described above. An SR(i) corresponds to magnitude mean of the $i^{th}$ frequency bin.

At 508, the technique 500 obtains respective gains of frequency bins of the bark domain with respect to a reference frequency response curve (Rf). The reference frequency response curve (Rf) can be obtained as described above. As such, the technique 300 can include, as described above, receiving a reference sample of the reference timbre; converting the reference sample into the time-frequency domain to obtain a reference time-frequency signal; obtaining reference frequency bin means of magnitudes ($M_j^{FFT}$) over time of the reference time-frequency signal; and converting the reference frequency bin means of magnitudes ($M_j^{FFT}$) into the bark domain to obtain the reference frequency response curve (Rf). The reference frequency response curve (Rf) includes respective bark domain frequency magnitudes ($M_i^{Bark}$) for respective bark domain frequency bins, i. As such, an Rf(i) corresponds to a magnitude mean of the $i^{th}$ frequency bin.

As described above, the technique 500 can convert the reference frequency bin means of magnitudes ($M_j^{FFT}$) into the bark domain to obtain a reference frequency response curve (Rf) using formula (1). As described above, obtaining respective gains of frequency bins of the bark domain can include calculating a gain $G^b$ (k) of a $k^{th}$ frequency bin in the bark domain using a ratio of the reference frequency bin magnitude mean of the $k^{th}$ frequency bin to the source frequency response curve (SR) of the $k^{th}$ frequency bin. The gain $G^b(k)$ can be calculated using formula (2).

At 510, the technique 500 can obtain equalizer parameters using the respective gains of the frequency bins of the Bark domain. In an example, obtaining the equalizer parameters using the respective gains of the frequency bins of the bark domain further can include mapping the respective gains to respective center frequencies of the equalizer to obtain values for gains of the equalizer. In an example, the technique 500 can normalize the respective gains to obtain the equalizer parameters. At 512, the technique 500 transforms the first portion to the reference timbre using the equalizer parameters. To illustrate, and without loss of generality, assume that an equalizer with 30 frequency bands is selected where the center frequencies of the frequency bands are $f\ c_i$, from $f\ c_i$ to $f\ c_{30}$, respectively; then the gain for each frequency band of the equalizer can be an interpolated gain $G_i^e$, derived using formula (3).

As described above with respect to detecting large variations, the technique 500 can further include obtaining a second source frequency response curve for a second portion of the source signal; in response to detecting a difference between the source frequency response curve and the second source frequency response curve exceeding a threshold, obtaining new equalizer parameters and using the new equalizer parameters as the equalizer parameters; and transforming the second portion of the source signal using the equalizer parameters, which may be the new equalizer parameters if a large variation is detected.

For simplicity of explanation, the techniques 100, 300, and 500 of FIGS. 1, 3, and 5, respectively, are each depicted and described as a series of blocks, steps, or operations. However, the blocks, steps, or operations in accordance with this disclosure can occur in various orders and/or concurrently. Additionally, other steps or operations not presented and described herein may be used. Furthermore, not all illustrated steps or operations may be required to implement a technique in accordance with the disclosed subject matter.

The word "example" is used herein to mean serving as an example, instance, or illustration. Any aspect or design described herein as "example" is not necessarily to be construed as being preferred or advantageous over other aspects or designs. Rather, use of the word "example" is intended to present concepts in a concrete fashion. As used in this application, the term "or" is intended to mean an inclusive "or" rather than an exclusive "or." That is, unless specified otherwise or clearly indicated otherwise by the context, the statement "X includes A or B" is intended to mean any of the natural inclusive permutations thereof. That is, if X includes A; X includes B; or X includes both A and B, then "X includes A or B" is satisfied under any of the foregoing instances. In addition, the articles "a" and "an" as used in this application and the appended claims should generally be construed to mean "one or more," unless specified otherwise or clearly indicated by the context to be directed to a singular form. Moreover, use of the term "an implementation" or the term "one implementation" throughout this disclosure is not intended to mean the same implementation unless described as such.

Implementations of the computing device 400, and/or any of the components therein described with respect to FIG. 4 and/or any of the components therein described with respect to modules or components of FIG. 1 or FIG. 3, (and any techniques, algorithms, methods, instructions, etc., stored thereon and/or executed thereby) can be realized in hardware, software, or any combination thereof. The hardware can include, for example, computers, intellectual property (IP) cores, application-specific integrated circuits (ASIC s), programmable logic arrays, optical processors, programmable logic controllers, microcode, microcontrollers, servers, microprocessors, digital signal processors, or any other suitable circuit. In the claims, the term "processor" should be understood as encompassing any of the foregoing hardware, either singly or in combination. The terms "signal" and "data" are used interchangeably.

Further, in one aspect, for example, the techniques described herein can be implemented using a general purpose computer or general purpose processor with a computer program that, when executed, carries out any of the respective methods, algorithms, and/or instructions described herein. In addition, or alternatively, for example, a special purpose computer/processor can be utilized which can contain other hardware for carrying out any of the methods, algorithms, or instructions described herein.

Further, all or a portion of implementations of this disclosure can take the form of a computer program product accessible from, for example, a computer-usable or computer-readable medium. A computer-usable or computer-readable medium can be any device that can, for example, tangibly contain, store, communicate, or transport the program for use by or in connection with any processor. The medium can be, for example, an electronic, magnetic, optical, electromagnetic, or semiconductor device. Other suitable mediums are also available.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A method for transforming a voice of a speaker to a reference timbre, comprising:

receiving, during a real-time communication session, a first portion of a source signal of the voice of the speaker;

converting the first portion into a time-frequency domain to obtain a time-frequency signal;

obtaining frequency bin means of magnitudes over time of the time-frequency signal;

converting the frequency bin magnitude means into a Bark domain to obtain a source frequency response curve (SR), wherein SR(i) corresponds to magnitude mean of the $i^{th}$ frequency bin;

obtaining respective gains of frequency bins of the Bark domain with respect to a reference frequency response curve (Rf);

obtaining equalizer parameters using the respective gains of the frequency bins of the Bark domain;

transforming, into a transformed portion, the first portion to the reference timbre using the equalizer parameters; and outputting the transformed portion such that the transformed portion is presented through a speaker.

2. The method of claim 1, further comprising:

receiving a reference sample of the reference timbre;

converting the reference sample into the time-frequency domain to obtain a reference time-frequency signal;

obtaining reference frequency bin means of magnitudes ($M_j^{FFT}$) over time of the reference time-frequency signal; and converting the reference frequency bin means of magnitudes into the Bark domain to obtain the reference frequency response curve (Rf).

3. The method of claim 2, wherein converting the reference frequency bin means of magnitudes ($M_j^{FFT}$) into the Bark domain to obtain a reference frequency response curve (Rf) comprises:

using a formula $M_i^{Bark}=\Sigma_{j\in B_i}\beta_{ij}*M_j^{FFT}$, wherein $B_i$ corresponds to FFT frequency bins in an ith Bark frequency band, and wherein $\beta_{ij}$ corresponds to transform parameters of the Bark transform.

4. The method of claim 2, wherein obtaining respective gains of frequency bins of the Bark domain comprises:

calculating a gain $G^b(k)$ of a $k^{th}$ frequency bin in the Bark domain using a ratio of the reference frequency bin magnitude mean of the $k^{th}$ frequency bin to the source frequency response curve (SR) of the $k^{th}$ frequency bin.

5. The method of claim 4, wherein the $G^b(k)$ is calculated using a formula $G^b(k)=20*\log(Rf(k)/SR(k))$.

6. The method of claim 1, wherein obtaining the equalizer parameters using the respective gains of the frequency bins of the Bark domain comprises:

normalizing the respective gains to obtain the equalizer parameters.

7. The method of claim 6, wherein obtaining the equalizer parameters using the respective gains of the frequency bins of the Bark domain further comprises:

mapping the respective gains to respective center frequencies of the equalizer to obtain values for gains of the equalizer.

8. The method of claim 1, further comprising:

receiving, from the speaker, the reference timbre.

9. The method of claim 1, further comprising:

obtaining a second source frequency response curve for a second portion of the source signal;

in response to detecting a difference between the source frequency response curve and the second source frequency response curve exceeding a threshold, obtaining new equalizer parameters, and using the new equalizer parameters as the equalizer parameters; and transforming the second portion of the source signal using the equalizer parameters.

10. An apparatus for transforming a voice of a speaker to a reference timbre, comprising:

a processor configured to:

receive, during a real-time communication session, a first portion of a source signal of the voice of the speaker;

convert the first portion into a time-frequency domain to obtain a time-frequency signal;

obtain frequency bin means of magnitudes over time of the time-frequency signal;

convert the frequency bin magnitude means into a Bark domain to obtain a source frequency response curve (SR), wherein SR(i) corresponds to magnitude mean of the $i^{th}$ frequency bin;

obtain respective gains of frequency bins of the Bark domain with respect to a reference frequency response curve (Rf);

obtain equalizer parameters using the respective gains of the frequency bins of the Bark domain;

transform, into a transformed portion, the first portion to the reference timbre using the equalizer parameters; and output the transformed portion such that the transformed portion is presented through a speaker.

11. The apparatus of claim 10, wherein the processor is further configured to:

receive a reference sample of the reference timbre;

convert the reference sample into the time-frequency domain to obtain a reference time-frequency signal;

obtain reference frequency bin means of magnitudes ($M_j^{FFT}$) over time of the reference time-frequency signal; and convert the reference frequency bin means of magnitudes into the Bark domain to obtain the reference frequency response curve (Rf).

12. The apparatus of claim 11, wherein to convert the reference frequency bin means of magnitudes ($M_j^{FFT}$) into the Bark domain to obtain a reference frequency response curve (Rf) comprises to:

use a formula $M_i^{Bark}=\Sigma_{j\epsilon B_i}\beta_{ij}*M_j^{FFT}$, wherein $B_i$ corresponds to FFT frequency bins in an ith Bark frequency band, and wherein $\beta_{ij}$ corresponds to transform parameters of the Bark transform.

13. The apparatus of claim 11, wherein to obtain respective gains of frequency bins of the Bark domain comprises to:

calculate a gain $G^b(k)$ of a $k^{th}$ frequency bin in the Bark domain using a ratio of the reference frequency bin magnitude mean of the $k^{th}$ frequency bin to the source frequency response curve (SR) of the $k^{th}$ frequency bin.

14. The apparatus of claim 13, wherein the $G^b(k)$ is calculated using a formula $G^b(k)=20*\log(Rf(k)/SR(k))$.

15. The apparatus of claim 10, wherein to obtain the equalizer parameters using the respective gains of the frequency bins of the Bark domain comprises to:

normalize the respective gains to obtain the equalizer parameters.

16. The apparatus of claim 15, wherein to obtain the equalizer parameters using the respective gains of the frequency bins of the Bark domain further comprises to:

map the respective gains to respective center frequencies of the equalizer to obtain values for gains of the equalizer.

17. The apparatus of claim 10, wherein the processor is further configured to:

receive, from the speaker, the reference timbre.

18. The apparatus of claim 10, wherein the processor is further configured to:

obtain a second source frequency response curve for a second portion of the source signal;

in response to detecting a difference between the source frequency response curve and the second source frequency response curve exceeding a threshold, obtain new equalizer parameters, and use the new equalizer parameters as the equalizer parameters; and transform the second portion of the source signal using the equalizer parameters.

19. A non-transitory computer-readable storage medium, comprising executable instructions that, when executed by a processor, facilitate performance of operations comprising:

receiving, during a real-time communication session, a first portion of a source signal of the voice of the speaker;

converting the first portion into a time-frequency domain to obtain a time-frequency signal;

obtaining frequency bin means of magnitudes over time of the time-frequency signal;

converting the frequency bin magnitude means into a Bark domain to obtain a source frequency response curve (SR), wherein SR(i) corresponds to magnitude mean of the $i^{th}$ frequency bin;

obtaining respective gains of frequency bins of the Bark domain with respect to a reference frequency response curve (Rf);

obtaining equalizer parameters using the respective gains of the frequency bins of the Bark domain;

transforming, into a transformed portion, the first portion to the reference timbre using the equalizer parameters; and outputting the transformed portion such that the transformed portion is presented through a speaker.

20. The non-transitory computer-readable storage medium of claim 19, wherein the operations further comprise:

obtaining a second source frequency response curve for a second portion of the source signal;

in response to detecting a difference between the source frequency response curve and the second source frequency response curve exceeding a threshold, obtaining new equalizer parameters, and using the new equalizer parameters as the equalizer parameters; and transforming the second portion of the source signal using the equalizer parameters.

* * * * *